US008133355B2

(12) United States Patent
Pulliainen et al.

(10) Patent No.: US 8,133,355 B2
(45) Date of Patent: Mar. 13, 2012

(54) METHOD FOR USE IN THE WET END OF A PAPER MACHINE, CARDBOARD MACHINE OR AN EQUIVALENT WEB FORMING MACHINE

(75) Inventors: Martti Pulliainen, Mikkeli (FI); Mikko Vepsalainen, Mikkeli (FI); Jukka Rautiainen, Mikkeli (FI); Matti Hakkinen, Mikkeli (FI); Pekka Kylliainen, Imatra (FI); Seppo Karine, Imatra (FI); Jari Rasanen, Imatra (FI); Kirsi Partti-Pellinen, Imatra (FI); Ari Johansson, Imatra (FI); Isto Heiskanen, Imatra (FI); Jyri Jarvi, Espoo (FI)

(73) Assignee: Savcor Process Oy, Mikkeli (FI)

( * ) Notice: Subject to any disclaimer, the term of this patent is extended or adjusted under 35 U.S.C. 154(b) by 804 days.

(21) Appl. No.: 12/091,783

(22) PCT Filed: Oct. 20, 2006

(86) PCT No.: PCT/FI2006/000340

§ 371 (c)(1),
(2), (4) Date: Aug. 27, 2008

(87) PCT Pub. No.: WO2007/051894

PCT Pub. Date: May 10, 2007

(65) Prior Publication Data

US 2009/0114359 A1 May 7, 2009

(30) Foreign Application Priority Data

Oct. 31, 2005 (FI) ..... 20051096

(51) Int. Cl.
*D21F 1/00* (2006.01)

(52) U.S. Cl. ..... 162/192; 162/190; 162/202; 162/289; 162/336; 162/343; 162/344; 162/264

(58) Field of Classification Search ..... 162/192, 162/202, 204, 205, 208, 210, 289, 308, 198, 162/348, 358.1, 351, 358.3, 361, 354, 352, 162/355, 356; 205/689–694
See application file for complete search history.

(56) References Cited

U.S. PATENT DOCUMENTS 894,070 A * 7/1908 Schwerin ..... 204/518
(Continued)

FOREIGN PATENT DOCUMENTS

FI 20002268 4/2002
(Continued)

OTHER PUBLICATIONS

JPO machine translation of JP 2002-138383.*
(Continued)

*Primary Examiner* — Eric Hug
*Assistant Examiner* — Peter Chin
(74) *Attorney, Agent, or Firm* — Cozen O'Connor

(57) ABSTRACT

The invention relates to a method in the wet end of a web forming process. In the method, at least one electrode pair (102, 103) is placed in the wet end. The electrode pair (102, 103) is supplied with a current/voltage from a power source (100), so that an electric field is set up between the electrode pair (102, 103), causing the material particles in the pulp suspension in the wet end to be electrically charged in a desired manner and to move in a desired manner in the pulp suspension in the wet end. The current/voltage of the power source (100) is controlled by means of a measuring and control unit (101) so as to cause the material particles in the pulp suspension to be electrically charged and to move in a desired manner, thus allowing the retention, formation and orientation of the material particles in the pulp suspension to be substantially improved.

1 Claim, 7 Drawing Sheets

U.S. PATENT DOCUMENTS

| | | | | |
|---|---|---|---|---|
| 1,881,985 | A * | 10/1932 | Von Hazmburg | 162/192 |
| 3,067,779 | A * | 12/1962 | Draper, Jr | 139/383 R |
| 3,633,282 | A | 1/1972 | Candor et al. | |
| 3,705,847 | A | 12/1972 | Stiles | |
| 3,757,426 | A | 9/1973 | Candor et al. | |
| 4,349,414 | A * | 9/1982 | Stenberg | 162/123 |
| 6,425,984 | B2 * | 7/2002 | Aidun | 162/343 |
| 6,572,733 | B1 | 6/2003 | Banerjee | |
| 2004/0238140 | A1 * | 12/2004 | Laitinen-Vellonen | 162/198 |

FOREIGN PATENT DOCUMENTS

| | | | |
|---|---|---|---|
| GB | 2294948 | A | 5/1996 |
| JP | 2002138383 | A | 5/2002 |
| JP | 2004300591 | A | 10/2004 |

OTHER PUBLICATIONS

JPO machine translation of JP 2004-300591.*

* cited by examiner

METHOD FOR USE IN THE WET END OF A PAPER MACHINE, CARDBOARD MACHINE OR AN EQUIVALENT WEB FORMING MACHINE

The present invention relates to a method as defined in the preamble of claim 1.

In the headbox of a paper machine, the solids content of the fiber suspension is of the order of 1% or even somewhat less. After the press section of the paper machine, the solids content of the fiber suspension has increased to the order of 40-50% or somewhat above this.

The biggest problem and drawback in the wet end of web forming machines, such as paper and cardboard machines, is an unsatisfactory retention or coefficient of efficiency, which is why a considerable amount of fibers and additives are removed together with the water from the fiber suspension. In the methods known at present, dewatering also causes drawbacks in the formation of the web being formed, in other words, the web being formed may have widely varying properties in the transverse direction of the web.

In the present patent application, the term "wet end" covers the short circulation before the headbox, the headbox, the wire section after the headbox and the press section.

The object of the invention is to achieve an improvement of currently known dewatering solutions in the wet end. A more specific object of the invention is to achieve a method that will permit dewatering in the wet end in a way that considerably improves retention. Yet another object of the invention is to achieve a method that improves the formation of the web being formed while improving the uniformity of the quality of the web in the transverse direction of the web.

The objects of the invention are achieved by a method that is characterized by the features disclosed in the characterization part of claim 1.

The method of the invention is based on the insight of using electrokinetic forces to improve retention and dewatering in different stages of e.g. a paper making process. 'Electrokinetic forces' refers to phenomena produced by an electric field, such as electrophoresis and electro-osmosis.

Electrophoresis refers to the motion of electrically charged particles in an electric field. Different ions have different velocities in an electric field, and the velocity depends, among other things, on the intensity of the electric field, the charge density of the ion, the viscosity of the solution and the size of the ion. Electro-osmotic flow again refers to the motion of the solution relative to a solid charged surface.

In the method of the invention, the current/voltage produced by a power source is controlled on the basis of an external measurement signal and/or an internal measurement signal. Alternatively, the current/voltage may be controlled on the basis of a control signal obtained from a data file.

In a preferred embodiment of the invention, mutually adjacent electrode pairs are caused to form electric fields differing in intensity, allowing desired transverse properties of the web being formed to be obtained.

In the method of the invention, it is possible to use direct current, pulsed direct current or alternating current to produce the desired electric field in order to improve retention and formation in the short circulation, headbox, wire section and press section and, if desirable, in the drying section of e.g. a paper machine. The electric field is formed by at least one electrode pair, and the electric field is controlled by means of a measuring and control unit, which adjusts the parameters affecting the electric field.

In the short circulation, electrophoresis is an applicable electrokinetic force. The electric field can be implemented using electrodes mounted in containers or pipe systems. One of the electrodes may consist of a metallic surface. Electrodes immersed in containers may be either inert or soluble. Of soluble electrodes, at least aluminum is applicable.

The electric field causes electrically charged fibers and additives to move in the direction of the electric field, and it also produces a variation of pH on the surfaces of the electrodes. The method aims at forming colloids and promoting the retention of fines and dissolved and colloid materials.

Possible mounting places for the system of the invention are the containers and pipings comprised in the short circulation. A possible mounting place for the electrodes is e.g. the wire pit. Via treatment of the headbox dilution water, it is possible to exert an influence, besides on retention, also on formation and the transverse distribution of additives, so that the web being formed will have a transverse profile as uniform as possible. A possible place for the treatment of the dilution water is e.g. the headbox dilution pipes.

In the wire section, electrophoresis can be used for the formation or dispersion of floccules, depending on the treatment place and the intensity of the electric field. If the apparatus is connected to the headbox dilution system, then the method aims at improving the retention of fillers and dissolved and colloid materials. When mounted in the headbox, the electric field can be used to prevent premature formation of floccules and to influence the formation of paper. In a headbox in which lamellae are used, it is also possible to bring about stratification of charged compounds, i.e. to produce a desired effect on the thickness-wise profile of the web being formed.

With the method of the invention, the operation of the headbox can be influenced so as to achieve a desired machine-direction fiber orientation in the web being formed.

In the case of Fourdrinier machines, a possible place for the enhancement of dewatering via electro-osmosis is the perforated roll. In the case of double wire machines, possible places for an electric field in the wire section are the load strips, suction boxes and the wires themselves.

In the press section, electrokinetic forces can be used to promote the dewatering process. Electro-osmotic flow has an importance in those stages of the papermaking process in which the solids content is high.

In a wet press, an electric field formed between rolls can be used to enhance dewatering by electro-osmosis. In the press, the particles are still at least partly in motion, so the electric field can also be utilized to bring about a distribution of the electrically charged particles in the direction of the electric field. Gaseous reaction products (oxygen, hydrogen) can be used to facilitate detachment of the paper web from the roll.

In the drying section, dewatering of the web can be facilitated by using electro-osmosis. A possible place for electro-osmosis is between the wet press and the drying section, and also in subsequent stages in the drying section.

The method of the invention can be applied directly by installing in existing structures an apparatus working according to the invention. If necessary, it is also possible to develop new structures to allow the method of the invention to be taken in use.

The invention will be described in more detail by referring to certain preferred embodiments of the invention presented in the attached drawings, but the invention is not exclusively limited to these embodiments.

Figure 3:
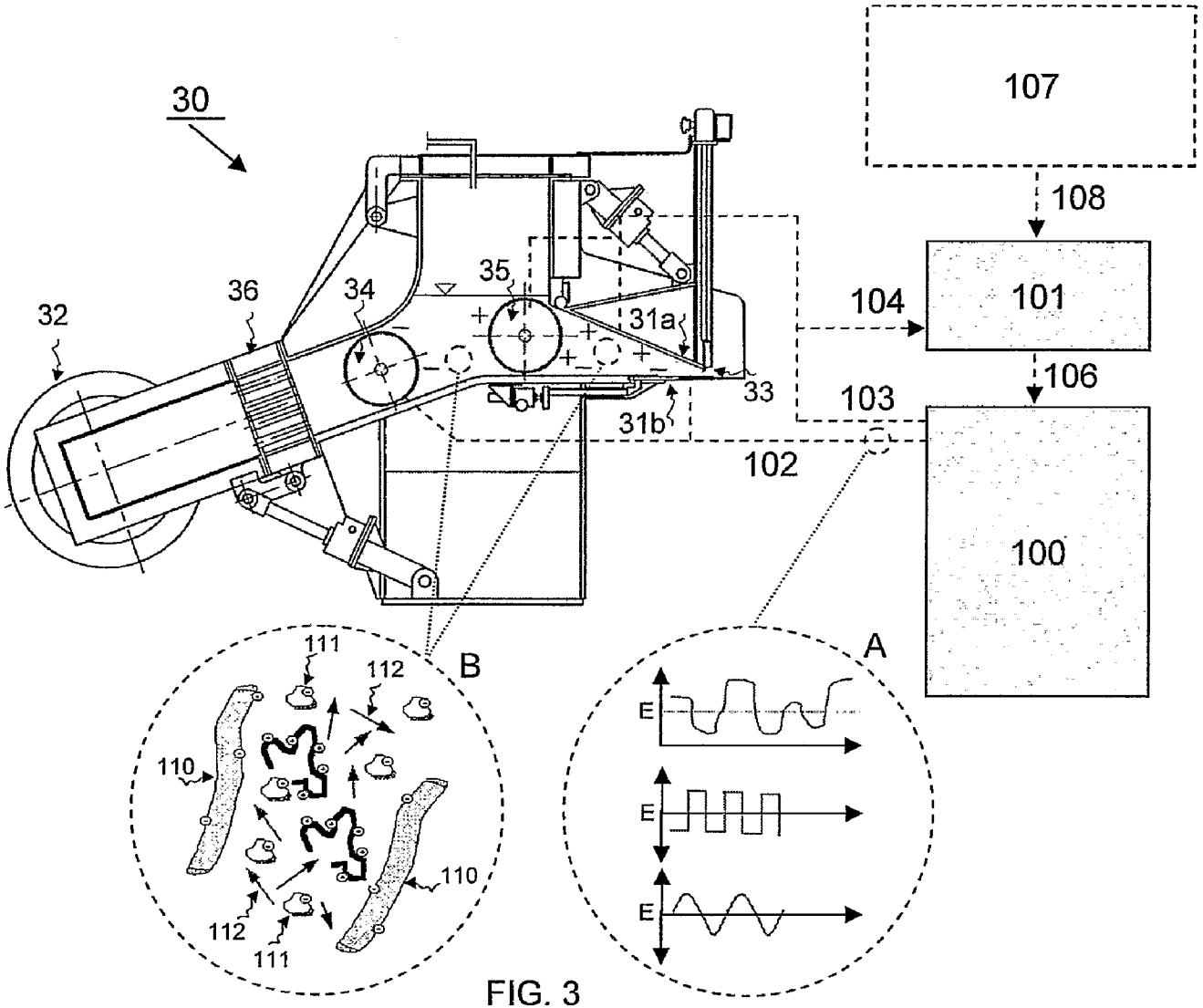
FIG. 3 represents a third preferred embodiment of the method of the invention in diagrammatic cross-sectional side view.
Figure 3A:
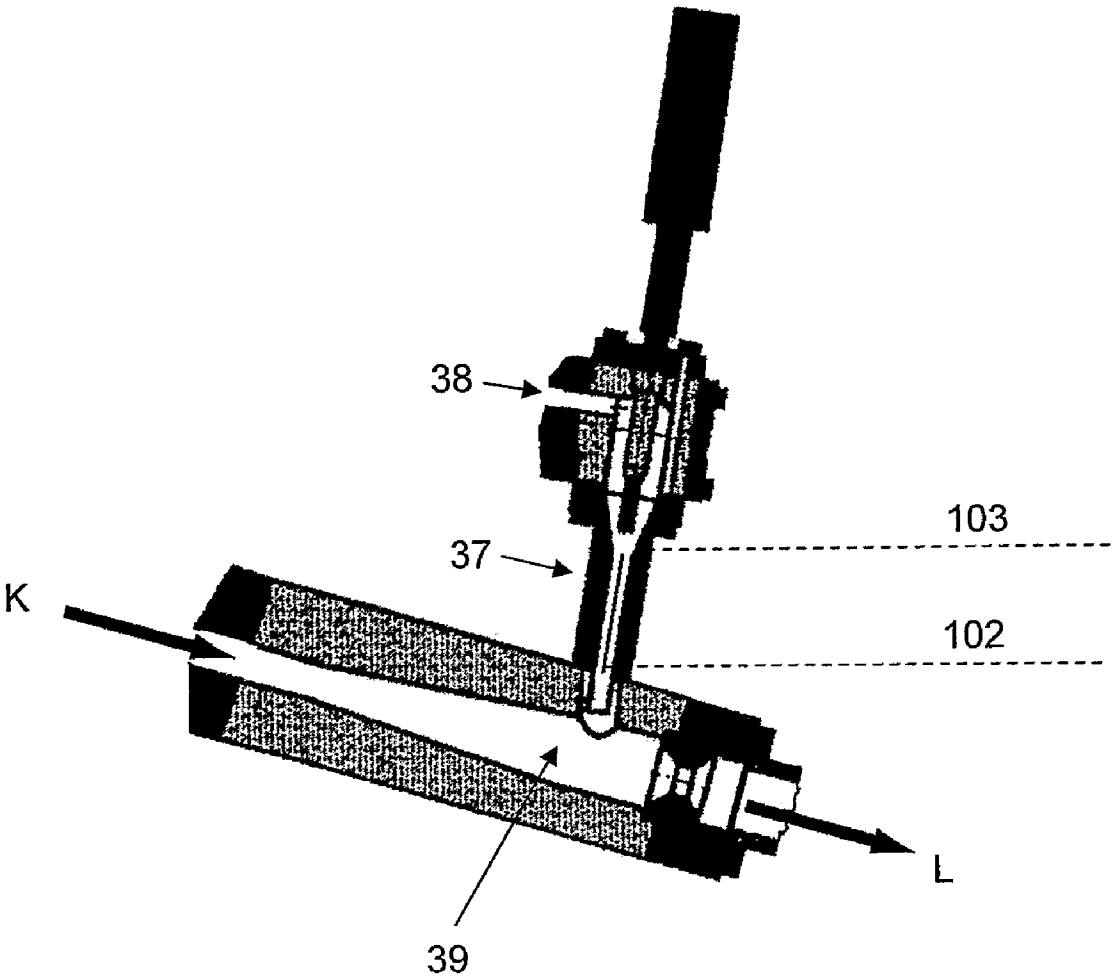

FIG. 3A presents a cross-sectional view of a dilution pipe.

Figure 4:
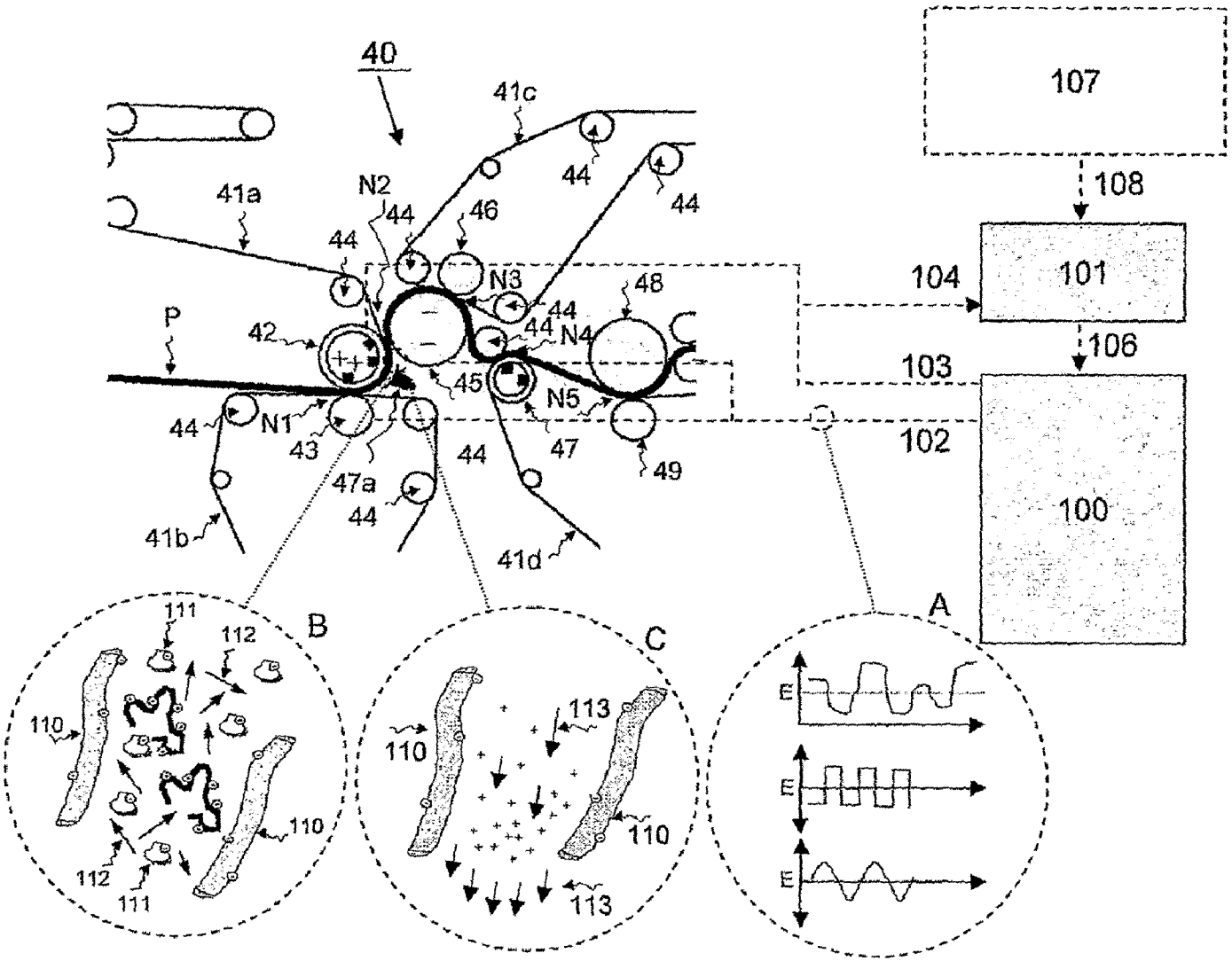

FIG. 4 represents a fourth preferred embodiment of the method of the invention in diagrammatic cross-sectional side view.

Figure 5:
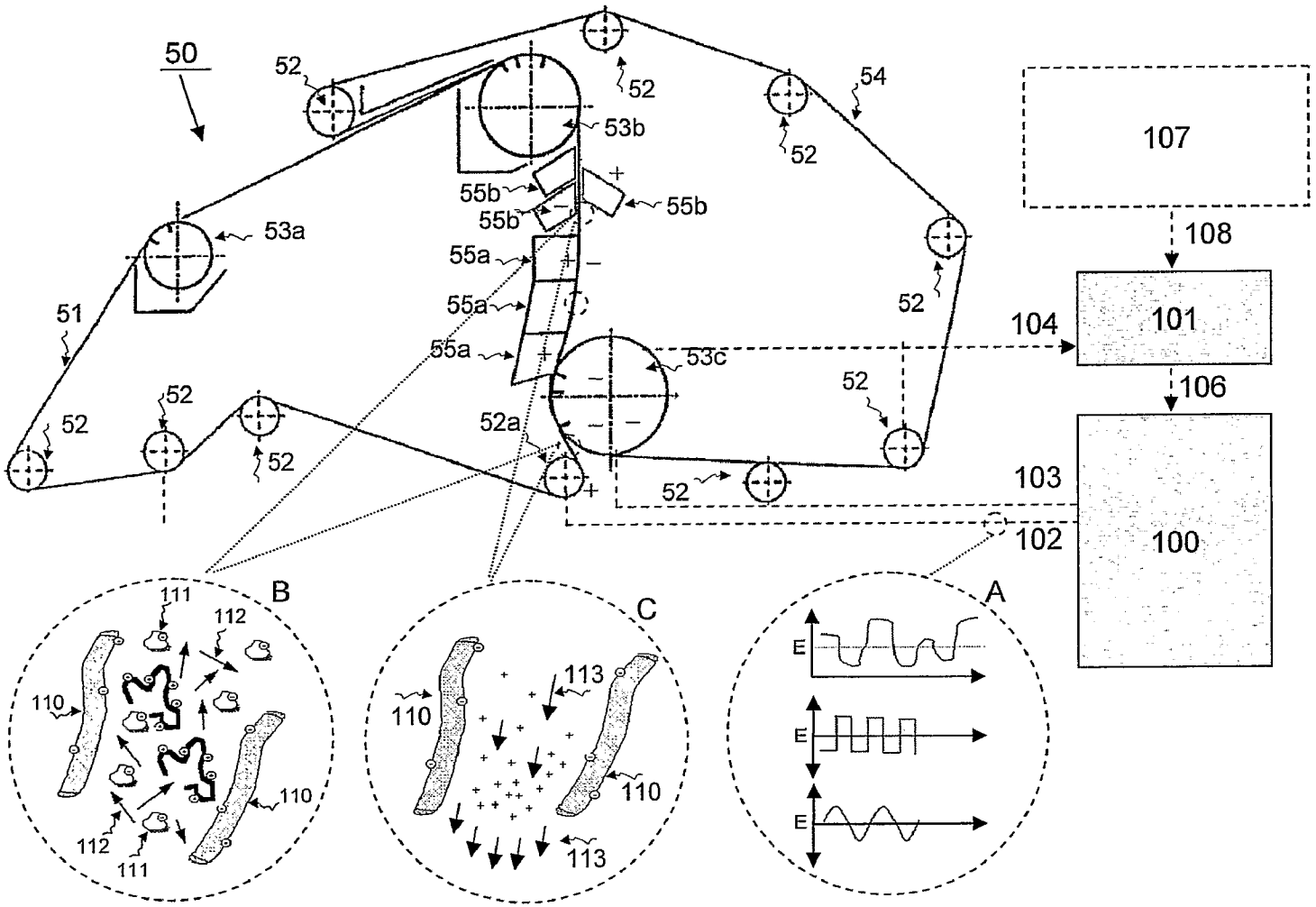

FIG. 5 represents a fifth preferred embodiment of the method of the invention in diagrammatic cross-sectional side view.

Figure 6:
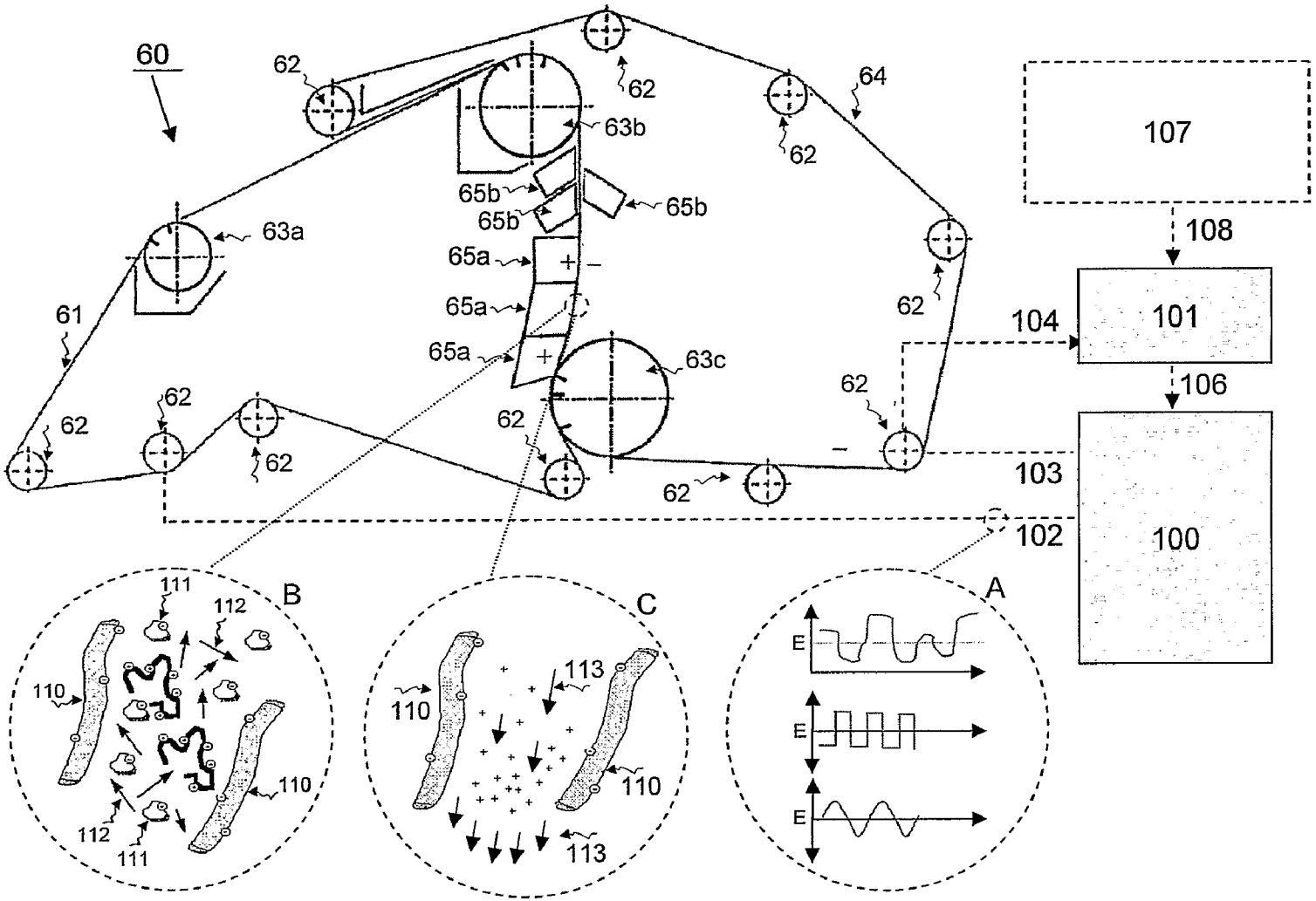

FIG. 6 represents a sixth preferred embodiment of the method of the invention in diagrammatic cross-sectional side view.

Figure 1:
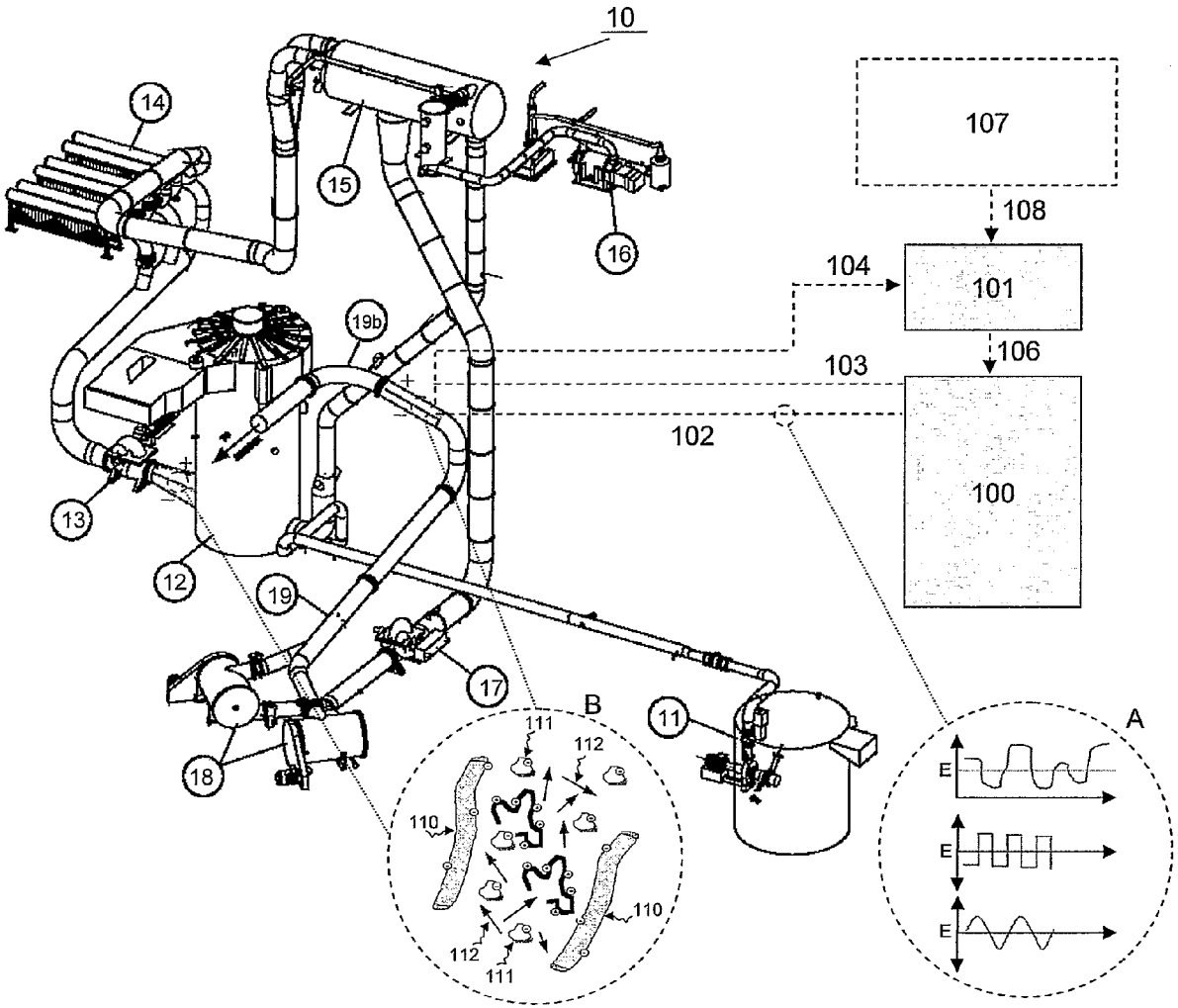
FIG. 1 represents a preferred embodiment of the method of the invention in diagrammatic side view.

In FIG. 1, the short circulation of a paper machine is indicated generally by reference number 10. In this embodiment, the machine container is indicated by reference number 11, the wire pit by reference number 12, the mixing pump by reference number 13, the centrifugal cleaning apparatus by reference number 14, the deaeration device by reference number 15, the vacuum pump by reference number 16, the headbox feed pump by reference number 17, the pressure screen by reference number 18, the radial dosing point by reference number 19 and the pipe leading to the headbox manifold by reference number 19*b*.

In the short circulation of the paper machine, desired additives and chemicals are mixed into the fiber suspension before the fiber suspension is passed through the bypass manifold into the headbox of the paper machine. As the short circulation forms part of prior-art technology known to a skilled person familiar with the paper machine industry, the short circulation illustrated in FIG. 1 will not be described in greater detail in the present patent application.

In the embodiment according to FIG. 1, a power source 100 has been fitted to supply an electrode pair 102, 103 with either direct current or alternating current or pulsed direct current, as visualized by magnified detail A. In this embodiment, the electrode pair 102, 103 is placed in a pipe 19*b* e.g. so that one 102 of the electrodes consists of the wall of the pipe 19*b* while the other electrode 103 is placed inside the pipe 19*b*. Placed inside the pipe 19*b* is also a sensor, in this embodiment e.g. a reference electrode 104. The sensor 104 may be any sensor that will provide the measuring and control unit 101 with data indicating the current state of the process e.g. in the headbox, wire section and press section of the paper machine. Based on a control signal 106, the measuring and control unit 101 controls the operation of the power source 100 in such a way that a desired electric field is formed between the electrode pair 102, 103, a desired electric charging of the fibers 110 and additives 111 and a desired motion of the fibers and additives are produced in the electric field generated by the electrode pair 102, 103. The electrode pair 102, 103 can also be placed e.g. in the wire pit 12, as illustrated in FIG. 1. If necessary, a large number of electrode pairs 102, 103 may be provided, and they can be placed at any desirable point in the short circulation.

The intensity of the electric field can also be controlled by only using a data file 107. The data file 107 receives information e.g. about the wet end, the drying section, the winders and naturally also about laboratory analyses. Such information includes e.g. moisture content, filler distribution, grammage profile, brightness, opacity, etc. Laboratory analyses provide information e.g. about the strength properties of the paper. The data file 107 also contains information about earlier current/voltage values obtained from the power source that have been found to be advantageous in regard of performance of the invention. The measuring and control unit 101 receives a control signal 108 from the data file 107.

Figure 2:
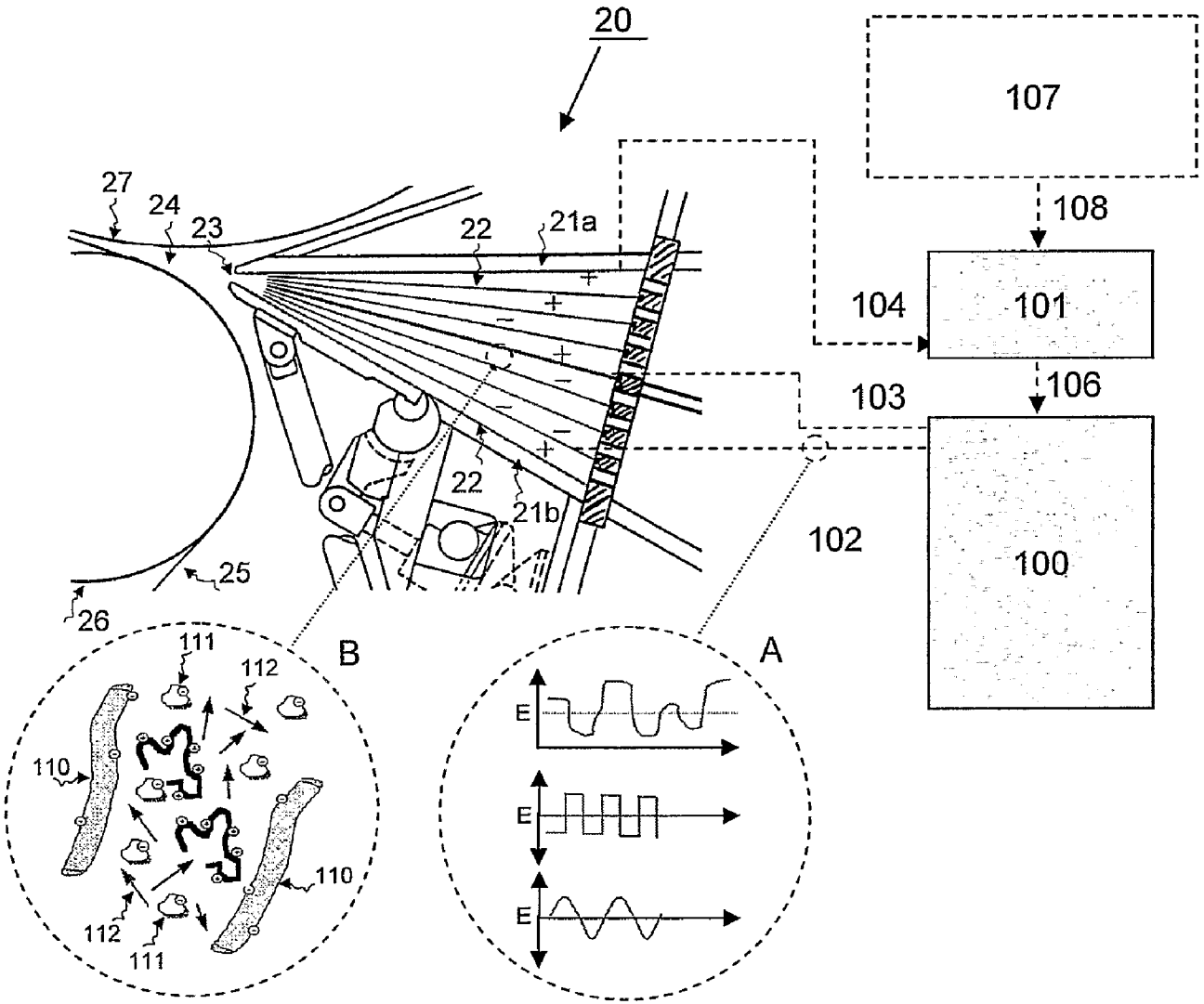
FIG. 2 represents a second preferred embodiment of the method of the invention in diagrammatic cross-sectional side view.

In the embodiment according to FIG. 2, the hydraulic headbox of a double-wire machine is indicated generally by reference number 20. Indicated by reference numbers 21*a* and 21*b* are the upper and lower edges of the slice channel, which form a slice 23. Reference number 22 indicates the lamellae. A lower wire 25 running over a roller 26 and an upper wire 27 running over another roller (not shown) form a gap 24. In double-wire machines, preferable places for an electric field are the lamellae 22 and the upper edge 21*a* and lower edge 21*b* of the slice channel. Electrode pairs 102, 103 are preferably placed over the entire width of the web being formed, thus giving the web being formed as uniform properties as possible in the transverse direction of the web.

The headbox, a so-called perforated roll headbox, presented in FIGS. 3 and 3A is indicated generally by reference number 30. The upper edge 31*a* and lower edge 31*b* of the slice channel form a slice 33. The fiber suspension is passed through the manifold 32 into the headbox 30. The perforated rolls 34 and 35 placed in the headbox preferably rotate in opposite directions. The dilution water is passed into the headbox 30 through dilution pipes 37 from point 36. An electrode pair 102, 103 is preferably formed by the perforated rolls 34 and 35 or by parts 31 of the upper and lower edge of the slice channel, or by both the perforated rolls 34 and 35 and parts 31 of the upper and lower edges of the slice channel, as proposed in this embodiment. As can be seen from FIG. 3A, dilution water is passed through an inlet duct 38 and dilution pipes 37 into space 39. From the manifold 32, flow K is passed into space 39. From space 39, flow L leads into the headbox 30.

The press section presented in FIG. 4 is indicated generally by reference number 40. The web P being formed passes through a nip $N_1$ formed by suction roll 42 and smooth-surfaced roll 43, a nip $N_2$ formed by suction roll 42 and the smooth-surfaced center roll 45, a nip $N_3$ formed by the smooth-surfaced center roll 45 and smooth-surfaced roll 46, a nip $N_4$ formed by guide roll 44 and suction roll 47 and a nip $N_5$ formed by smooth-surfaced roll 48 and smooth-surfaced roll 49, so that the solids content of the paper web P being formed increases as the web P is passing through the press section. Reference numbers 41*a*, 41*b*, 41*c* and 41*d* indicate felts, and reference number 44 indicates their guide rolls. Reference number 47*a* indicates the steam box. The press section 40 of a paper machine presented in FIG. 4 is known in itself, so it will not be described in greater detail in this patent application, because the operation of the press section 40 is obvious to a skilled person familiar with the paper machine industry.

In the embodiment according to FIG. 4, an electrode pair 102, 103 is formed by smooth-surfaced roll 43 and suction roll 42. A second electrode pair 102, 103 is formed by the smooth-surfaced center roll 45 and suction roll 42. The arrangement may naturally also comprise more electrode pairs. In FIG. 4, detail C shows that dewatering is enhanced when the method of the invention is used. It can be seen from detail C that electro-osmotic flow refers to a flow of the solvent towards an electrode. The motion 113 results from the motion of dissolved ions in the water towards an electrode. An anion (−) moves towards the anode (+) and a cation (+) moves towards the cathode (−). The motion of the ions at the same time also produces a flow of the solvent towards the electrode. If the anions (−) in the liquid are large and therefore do not move significantly while the cations (+) move fast towards the electrode, then the net flow is towards the cathode. The same applies vice versa, i.e. the net flow may also be towards the anode. The flow depends on the mobility of the compounds in the electric field, and the mobility again depends on factors including viscosity, molecular size and charge density.

The wire section presented in FIG. 5 is indicated generally by reference number 50. The motion of wire 51, i.e. the lower wire, is guided by guide rolls 52. The wet web supported by the lower wire 51 and upper wire 54 runs over suction roll 53*c* and suction boxes 55*a* to suction roll 53*b*, water being thereby removed from the web. Water is additionally removed from the fiber suspension web moving on the wire by suction roll 53*a*.

In the embodiment according to FIG. 5, an electrode pair 102, 103 is formed by guide roll 52*a* and suction roll 53*c*. In this embodiment, another electrode pair is formed by load strips 55*b*. Details A, B and C correspond to those in FIG. 4.

The wire section presented in FIG. 6 is indicated generally by reference number 60. This wire section 60 is fully identical in structure with the wire section 50 illustrated in FIG. 5. Thus, components 61-65*a*, 65*b* correspond to components 51-55*a*, 55*b* of wire section 50. In the embodiment according to FIG. 6, one of the electrodes in the electrode pair 102, 103 is wire 61, which is made of electrically conductive material, e.g. electrically conductive plastic, and the other electrode is wire 64, which is made of electrically conductive material, e.g. electrically conductive plastic. The wire sections according to FIGS. 5 and 6 are known in themselves, so they will not be described in greater detail in this patent application, because the operation of the wire sections 50 and 60 is obvious to a skilled person familiar with the paper machine industry.

In the foregoing, only a few preferred embodiments of the method of the invention have been described, and it is obvious to a person skilled in the art that they can be modified in numerous ways within the scope of the inventive concept presented in the following claims.

The invention claimed is:

1. Method in the wet end of a web forming machine, in which method water is removed from the web (P) being formed so as to increase the solids content of the pulp suspension, wherein the method comprises (a) placing at least one electrode pair (102, 103) in the wet end, (b) supplying said electrode pair (102, 103) with a current/voltage from a power source (100), so that between said electrode pair (102, 103) an electric field is set up, causing material particles (110, 111) in the pulp suspension in the wet end to be electrically charged, (c) controlling the current/voltage of said power source (100) by means of a measuring and control unit (101) so as to cause said material particles (110, 111) in said pulp suspension to be electrically charged, with the result that the retention, formation and orientation of said material particles (110, 111) in said pulp suspension are substantially improved, and (d) forming said at least one electrode pair (102, 103) from dilution pipes (37) of a headbox (20, 30).

* * * * *